US012376624B2

(12) United States Patent
Liao

(10) Patent No.: US 12,376,624 B2
(45) Date of Patent: Aug. 5, 2025

(54) LOW-TEMPERATURE BAKED DEVICE

(71) Applicant: SHENZHEN SMOORE TECHNOLOGY LIMITED, Shenzhen (CN)

(72) Inventor: Yancheng Liao, Guangdong (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 343 days.

(21) Appl. No.: 17/635,380

(22) PCT Filed: Aug. 13, 2020

(86) PCT No.: PCT/CN2020/109011
§ 371 (c)(1),
(2) Date: Feb. 15, 2022

(87) PCT Pub. No.: WO2021/027899
PCT Pub. Date: Feb. 18, 2021

(65) Prior Publication Data

US 2022/0330612 A1 Oct. 20, 2022

(30) Foreign Application Priority Data

Aug. 15, 2019 (CN) ..... 201910754223.X

(51) Int. Cl.
*A24F 40/46* (2020.01)
*A24F 40/20* (2020.01)
*A24F 40/42* (2020.01)

(52) U.S. Cl.
CPC ..... *A24F 40/46* (2020.01); *A24F 40/20* (2020.01); *A24F 40/42* (2020.01)

(58) Field of Classification Search
None
See application file for complete search history.

(56) References Cited

U.S. PATENT DOCUMENTS 10,188,148 B2 1/2019 Althorpe et al.
10,542,781 B2 1/2020 Althorpe et al.
(Continued)

FOREIGN PATENT DOCUMENTS

CN 207220165 U 4/2018
CN 207236082 U 4/2018
(Continued)

OTHER PUBLICATIONS

Li, English translation of CN-108158043-B, Mar. 9, 2018, Copyright © 2025 Clarivate Analytics, pp. 1-9 (Year: 2018).*
(Continued)

*Primary Examiner* — Philip Y Louie
*Assistant Examiner* — Jeffrey A. Buckman
(74) *Attorney, Agent, or Firm* — Andrew C. Cheng

(57) ABSTRACT

A low-temperature baked device including a main body, a heating assembly, and a driving assembly. The main body defines a receiving space for receiving a cigarette; the heating assembly includes an insertion portion for inserting into the cigarette, and the driving assembly is coupled to the heating assembly. The heating assembly can move linearly under a drive of the driving assembly along an axial direction of the cigarette between a first position for inserting into the cigarette, and a second position for separating from the cigarette. When the heating assembly is located at the first position, the insertion portion is extended completely into the receiving space. When the heating assembly is located at the second position, the heating assembly is at least partially displaced out of the receiving space and is separated from the cigarette, thus the cigarette can be readily removed without leaving any residues therein.

14 Claims, 4 Drawing Sheets

(56) References Cited

U.S. PATENT DOCUMENTS

| | | | | |
|---|---|---|---|---|
| 2017/0172215 | A1 | 6/2017 | Li | |
| 2017/0360092 | A1 | 12/2017 | Althorpe et al. | |
| 2019/0116885 | A1 | 4/2019 | Althorpe et al. | |
| 2020/0008477 | A1* | 1/2020 | Ouyang | A24F 40/46 |
| 2020/0113231 | A1 | 4/2020 | Althorpe et al. | |
| 2021/0076741 | A1* | 3/2021 | Chen | A24F 40/46 |
| 2021/0244096 | A1* | 8/2021 | Van Lancker | A24F 40/50 |

FOREIGN PATENT DOCUMENTS

| | | | | |
|---|---|---|---|---|
| CN | 207236083 | U | 4/2018 | |
| CN | 108158043 | A | 6/2018 | |
| CN | 108158043 | U | 6/2018 | |
| CN | 108433195 | A | 8/2018 | |
| CN | 108451050 | A | 8/2018 | |
| CN | 108497560 | A | 9/2018 | |
| CN | 207912057 | U | 9/2018 | |
| CN | 108669658 | A | 10/2018 | |
| CN | 207927770 | U | 10/2018 | |
| CN | 108783611 | A | 11/2018 | |
| CN | 108783612 | A | 11/2018 | |
| CN | 2086064484 | U | 11/2018 | |
| CN | 208192145 | U | 12/2018 | |
| CN | 208259018 | U | 12/2018 | |
| CN | 208286375 | U | 12/2018 | |
| CN | 109222244 | A | 1/2019 | |
| CN | 208370948 | U | 1/2019 | |
| CN | 109315836 | A | 2/2019 | |
| CN | 109430948 | A | 3/2019 | |
| CN | 208573038 | U | 3/2019 | |
| CN | 109588788 | A | 4/2019 | |
| CN | 208863584 | U | 5/2019 | |
| CN | 208863591 | U | 5/2019 | |
| CN | 208863592 | U | 5/2019 | |
| CN | 109832674 | A | 6/2019 | |
| CN | 208957014 | U | 6/2019 | |
| CN | 209002931 | U | 6/2019 | |
| CN | 209031255 | U | 6/2019 | |
| CN | 209031266 | U | 6/2019 | |
| CN | 209073554 | U | 7/2019 | |
| CN | 209202161 | U | 8/2019 | |
| CN | 209202162 | U | 8/2019 | |
| CN | 209498576 | U | 10/2019 | |
| CN | 209498593 | U | 10/2019 | |
| CN | 110447969 | A | 11/2019 | |
| CN | 110859326 | A | 3/2020 | |
| CN | 110870589 | A | 3/2020 | |
| CN | 111067143 | A | 4/2020 | |
| CN | 111317178 | A | 6/2020 | |
| CN | 210901380 | U | 7/2020 | |
| CN | 108158043 | B * | 7/2023 | A24F 47/008 |
| DK | 3220987 | T3 | 7/2019 | |
| EP | 3220987 | B1 | 5/2019 | |
| EP | 3524304 | A1 | 8/2019 | |
| ES | 2738730 | T3 | 1/2020 | |
| HR | P20191212 | T1 | 10/2019 | |
| HU | E045363 | T2 | 12/2019 | |
| JP | 2018174802 | A | 11/2018 | |
| JP | 2019088201 | A | 6/2019 | |
| PT | 3220987 | T | 8/2019 | |
| WO | 2013131763 | A1 | 9/2013 | |
| WO | 2016079155 | A1 | 5/2016 | |

OTHER PUBLICATIONS

International Search Report with English translation of PCT Patent Application No. PCT/CN2020/109011 issued on Nov. 17, 2020.

Written Opinion of the International Searching Authority with English translation of PCT Patent Application No. PCT/CN2020/109011 issued on Nov. 17, 2020.

The Office Action of JP application No. 2022-509140 issued on Feb. 28, 2023.

The Office Action of JP application No. 2022-509140 issued on Aug. 1, 2023.

International Search Report of PCT Patent Application No. PCT/CN2020/109011 issued on Nov. 17, 2020.

Written Opinion of the International Searching Authority of PCT Patent Application No. PCT/CN2020/109011 issued on Nov. 17, 2020.

The First Office Action of CN patent application No. 201910754223.X issued on Jan. 26, 2024.

The Search Report of CN patent application No. 201910754223.X issued on Jan. 26, 2024.

The First Office Action of KR patent application No. 10-2022-7005493 issued on Jan. 27, 2024.

The extended European search report of EP application No. 20851557.7 issued on Aug. 12, 2022.

The Second Office Action of CN patent application No. 201910754223.X issued on Jul. 16, 2024.

The Search Report of CN patent application No. 201910754223.X issued on Jul. 16, 2024.

The Written Decision on Registration of KR patent application No. 10-2022-7005493 issued on Jul. 22, 2024.

The Third Office Action of CN patent application No. 201910754223.X issued on Sep. 25, 2024.

The Search Report of CN patent application No. 201910754223.X issued on Sep. 25, 2024.

* cited by examiner

LOW-TEMPERATURE BAKED DEVICE

FIELD OF THE DISCLOSURE

The present disclosure relates to a smoking device, and more particularly to a low-temperature baked device.

BACKGROUND OF THE DISCLOSURE

As a newly developed technology, traditional cigarettes smoked by burning the tobacco have been replaced by electronic cigarettes which are smoked by heating e-liquid or low-temperature cigarettes. The electronic cigarette has a low working temperature, and the harmful components in the aerosol generated by the electronic cigarette are far less than traditional cigarettes. The electronic cigarette can greatly avoid the adverse effects from cigarettes to the human body and thus become a healthier way of smoking.

Currently, there are two typical electronic cigarettes in the market. The first one is an electronic atomization device that generates inhalable aerosol by evaporating an atomizable liquid. The second one is a low-temperature baked device that heats a tobacco at a low temperature (for example 200-400 degrees Celsius) without combustion to generate inhalable aerosol. For the low-temperature baked device, generally a heating element such as a heating sheet is inserted into the cigarette so as to heat up the cigarette. Normally, the heating temperature is controlled to range between 200 to 400 degrees Celsius so as to disintegrate and vaporize the ingredients of the cigarette to generate inhalable aerosol. When a cigarette is heated over a certain period of time, the cigarette will reach to its maximum production of aerosol, and the cigarette needs to be pulled out of the device to stop from inhaling or to continue inhaling by replacing a new cigarette. Thus, how to conveniently and quickly pull the exhausted cigarette out of the device without leaving residues on the heating element has become an essential problem. Currently, after the cigarette is consumed, the cigarette is removed from the device manually by pulling the cigarette so as to disengage the cigarette from the heating element. However, due to the fact that the pulling strengths and directions of the users are different, unwanted situations, i.e. the cigarette is broken apart, or there is some residues attached to the heating element, tend to be caused when pulling the cigarette by many users, which will affect the use experience of the user when uses next time.

SUMMARY OF THE DISCLOSURE

The purpose of the present disclosure is to provide a low-temperature baked device which can resolve the above-described defects.

The technical solution adopted by the present disclosure is to provide a low-temperature baked device including a main body, a heating assembly, and a driving assembly; wherein the main body defines a receiving space for receiving a cigarette; the heating assembly includes an insertion portion for inserting into the cigarette, and the driving assembly is coupled to the heating assembly; and wherein the heating assembly is disposed in the main body, and is able to move linearly under a drive of the driving assembly along an axial direction of the cigarette between a first position at which the heating assembly is inserted into the cigarette, and a second position at which the heating assembly is at least partly separated from the cigarette; and wherein the insertion portion is extended completely into the receiving space when the heating assembly is located at the first position, and the heating assembly is at least partially displaced out of the receiving space when the heating assembly is located at the second position.

In some embodiments, the main body includes an outer shell and a pushing tube disposed in the outer shell, an inner hole of the pushing tube defines the receiving space; and one end in an axial direction of the pushing tube defines a first inserting port for insertion of the cigarette, and another end in an axial direction of the pushing tube is provided with a bottom wall, and a second inserting port is defined in the bottom wall for insertion of the insertion portion.

In some embodiments, the driving assembly includes an electric motor disposed in the outer shell, and the electric motor is coupled with the heating assembly so as to drive the heating assembly to move linearly between the first position and the second position.

In some embodiments, the electric motor is a linear electric motor having an output shaft coupled with the heating assembly so as to drive the heating assembly to move linearly between the first position and the second position along the axial direction of the cigarette.

In some embodiments, the driving assembly further includes a mounting seat for disposing the heating assembly; and the mounting seat connects the electric motor with the heating assembly so as drive the heating assembly to move linearly between the first position and the second position along the axial direction of the cigarette.

In some embodiments, the electric motor is a rotational electric motor, and the driving assembly further includes a screw coupled with an output shaft of the rotational electric motor, and an axis of the screw is in parallel to an axis of the cigarette; and the mounting seat is sleeved onto the screw in a threaded connection, so as to drive the heating assembly to move linearly between the first position and the second position along the axial direction of the cigarette.

In some embodiments, axes of the screw and the rotational electric motor are staggered with that of the heating assembly.

In some embodiments, the mounting seat is sleeved on the heating assembly, and an external dimension of the mounting seat is larger than a dimension of the second inserting port.

In some embodiments, the heating assembly includes a heating element and a bracket, and the heating element is installed onto the mounting seat through the bracket; and an end portion of the heating element facing the first inserting port forms the insertion portion.

In some embodiments, the bracket is provided with a first contact for electrically interconnecting with the heating element, and the mounting seat is provided with a second contact, and the first contact is in contact conduction with the second contact when the bracket is installed onto the mounting seat.

In some embodiments, the heating element is sheet-shaped, and an end portion of the heating element facing the first inserting port is isosceles triangular or isosceles trapezoid.

In some embodiments, the heating element is rod-shaped, and an end portion of the heating element facing the first inserting port is conical or a truncated conical.

In some embodiments, the outer shell is provided with a first guide portion extending along a moving direction of the heating assembly, and the mounting seat is provided with a second guide portion slidably coupled with the first guide portion via a convex/concave fit.

In some embodiments, the outer shell includes a lower case and an upper case covered on an upper end of the lower case, and the pushing tube is disposed on a top portion of the lower case; the lower case is provided with a partition to support the pushing tube, and the partition is provided with a through hole corresponding to the second inserting port, and shapes of the second inserting port and the through hole are matched with a shape of a cross section of the insertion portion.

In some embodiments, the outer shell includes a lower case and an upper case covered on an upper end of the lower case, and the pushing tube is integrally formed with the upper case.

In some embodiments, the low-temperature baked device further includes a battery disposed in the outer shell, and a circuit board powered by the battery, the circuit board is electrically connected to the heating assembly and the electric motor respectively.

Implementation of the present disclosure provides at least the following advantages: the heating assembly of the low-temperature baked device is able to move reciprocally between the first position and the second position; when the heating assembly is located at the first position, the heating assembly can heat up the cigarette disposed within the receiving space; and when the heating assembly is located at the second position, the heating assembly is at least partly separated from the cigarette, thus the cigarette can be readily removed therefrom without leaving any residues therein; in addition, since the heating assembly is driven to move in the axial direction of the cigarette, the cigarette is free from being broken apart.

DESCRIPTION OF THE DRAWINGS

A detailed description of the present disclosure will be provided below with reference to the attached drawings and embodiments, and in the drawings.

DESCRIPTION OF THE EMBODIMENTS

Figure 1:
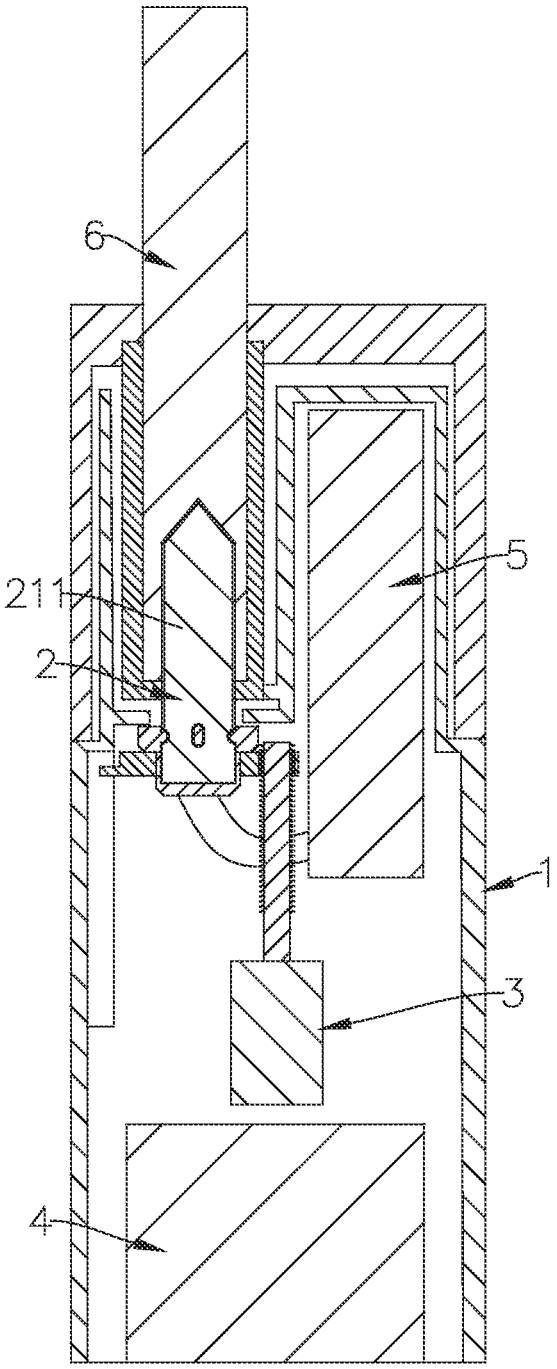
FIG. 1 is a longitudinal sectional view of a low-temperature baked device with a cigarette therein in a first embodiment.
Figure 2:
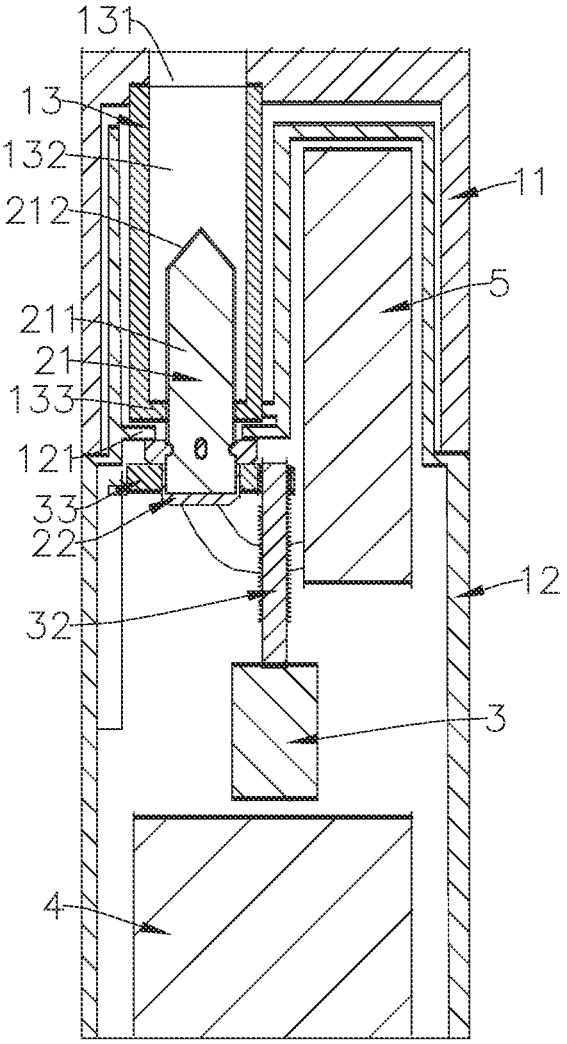
FIG. 2 is a sectional view of the low-temperature baked device shown in FIG. 1 in which a heating assembly is located at a first position.
Figure 3:
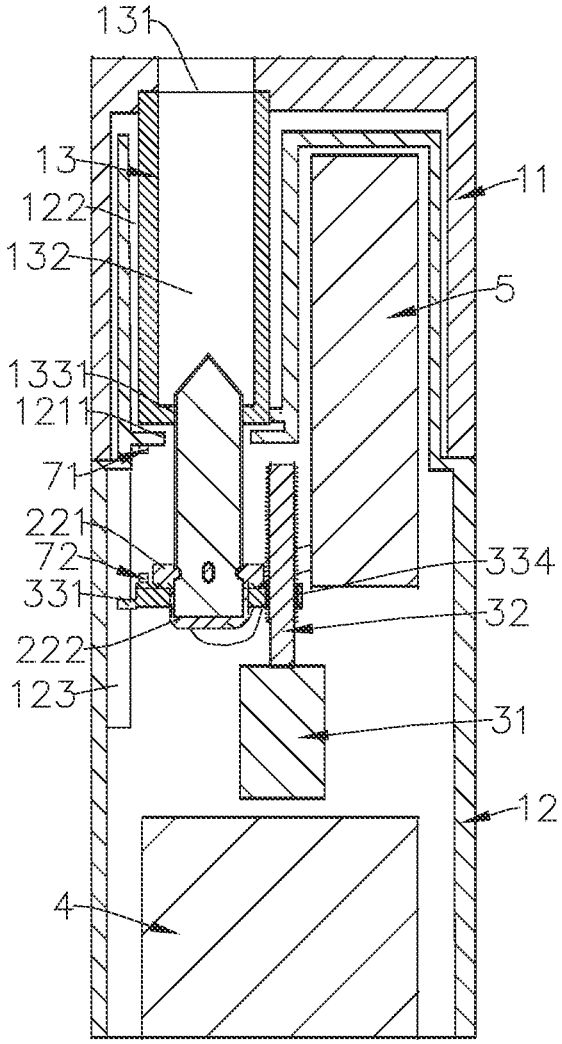
FIG. 3 is a sectional view of the low-temperature baked device shown in FIG. 1 in which the heating assembly is located at a second position.
Figure 4:
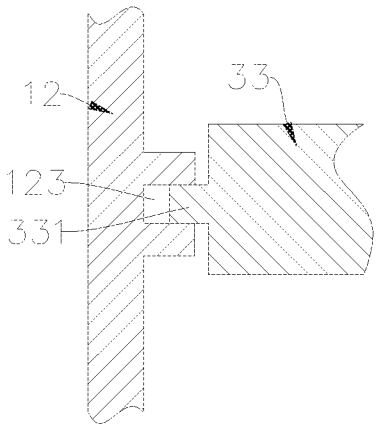
FIG. 4 is a lateral sectional view of the low-temperature baked device shown in FIG. 1.
Figure 5:
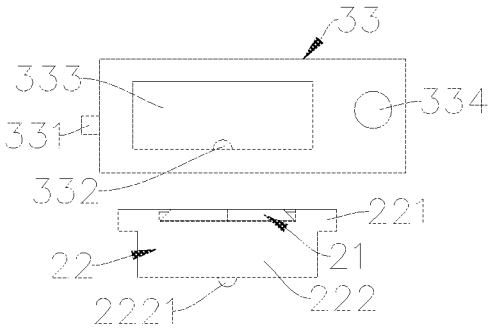
FIG. 5 is a top view of the heating assembly and a mounting seat in a disengaged state in the low-temperature baked device shown in FIG. 1.

To clearly understand technical features, objects and effects of the disclosure, the specific embodiments of the disclosure will now be described in detail with reference to the accompanying drawings.

As shown in FIGS. 1-5, a low-temperature baked device according a first embodiment of the present disclosure includes a main body 1, a heating assembly 2, a driving assembly 3, a battery 4, and a circuit board 5. The main body 1 defines a receiving space 132 for receiving a cigarette 6 therein. The heating assembly 2 includes an insertion portion 211 for inserting with the cigarette 6. The heating assembly 2 is disposed in the main body 1, and is able to move between a first position for inserting in the cigarette 6, and a second position for separating from the cigarette 6. When the heating assembly 2 is located at the first position, the insertion portion 211 extends completely in the receiving space 132; and when the heating assembly 2 is located at the second position, the insertion portion 211 is at least partially displaced out of the receiving space 132.

In some embodiments, the main body 1 may include an outer shell and a pushing tube 13 disposed in the outer shell. The outer shell may include a lower case 12, and an upper case 11 covered on an upper end of the lower case 12. The pushing tube 13 has a pipe configuration, and an inner hole therein defines the receiving space 132. One end along an axial direction of the pushing tube 13 is provided with a first inserting port 131 for insertion of the cigarette 6, and another end along an axial direction of the pushing tube 13 is provided with a bottom wall 133. The bottom wall 133 defines a second inserting port 1331 for insertion of the heating assembly 2.

In some embodiments, the pushing tube 13 may be fixed to a top wall of the lower case 12. A top portion of the lower case 12 is provided with a receiving slot 122 for installation of the pushing tube 13. A top end of the receiving slot 122 is open for receiving the pushing tube 13. A bottom portion of the receiving slot 122 is provided with a partition 121 to support the pushing tube 13 thereon. The partition 121 defines a through hole 1211 in align with the second inserting port 1331. By the arrangement, the heating assembly 2 can be inserted into the receiving space 132 through the through hole 1211 and the second inserting port 1331 so as to heat up the cigarette 6 disposed within the receiving space 132. In some embodiments, the shapes of the second inserting port 1331 and the through hole 1211 are matched with that of a cross section of the insertion portion 211. For example, the second inserting port 1331 and the through hole 1211 can have a rectangular shape such that when the insertion portion 211 is being separated from the cigarette 6, the insertion portion 211 can be readily cleaned through the bottom wall 133 and the partition 121. In the present embodiment, a cross-sectional area of the second inserting port 1331 is smaller than that of the through hole 1211. In other embodiment, the cross-sectional area of the second inserting port 1331 may be alternatively larger or equal to that of the through hole 1211. In another embodiment, the pushing tube 13 can be integrally formed with the upper case 11.

The heating assembly 2, the driving assembly 3, the battery 4 and the circuit board 5 are all mounted within the main body 1. The heating assembly 2 includes a heating element 21 with one end extending into the receiving space 132 through the second inserting port 1331. One end portion of the heating element 21 facing the first inserting port 131 configures the insertion portion 211. When the heating element 21 is powered by the battery 4, it heats up the cigarette 6 received in the receiving space 132. In some embodiment, the heating element 21 is sheet shaped, and the second inserting port 1331 is a rectangular hole with a shape corresponding to that of the heating element 21. The heating element 21 has an end portion 212 facing the first inserting port 131 which may be isosceles triangular or isosceles trapezoid. Alternatively, the end portion 212 of the heating element 21 may have other shape, and widths of the end portion 212 gradually increase along a direction from an end adjacent to the first inserting port 131 to an end away from the first inserting port 131, so as to facilitate insertion into the cigarette 6 for heating. In other embodiments, the heating element 21 may be rod shaped, and the shape of the cross section of the second inserting port 1331 is matched with that of the heating element 21. The end portion 212 of the heating element 21 facing the first inserting port 131 can be conical, or truncated conical. Alternatively, the end portion 212 of the heating element 21 may have other shape, and widths of the cross sections of the end portion 212 gradually increase along a direction from an end adjacent to the first inserting port 131 to an end away from the first inserting port 131, so as to facilitate insertion into the cigarette 6 for heating.

The heating assembly 2 is coupled with the driving assembly 3. The heating assembly 2 can be driven by the driving assembly 3 to move linearly and reciprocally via the second inserting port 1331 between a first position adjacent to the first inserting port 131, and a second position away from the first inserting port 131. When the heating assembly 2 is located at the first position, the heating assembly 2 extends into the receiving space 132 and is further inserted into the cigarette 6 for heating the cigarette 6 up. When the heating assembly 2 is located at the second position, the heating assembly is at least partly separated from the cigarette 6. As a result, the cigarette 6 can be removed from the receiving space 132 by the user without leaving any residues therein.

In some embodiments, the driving assembly 3 may include an electric motor 31 which is configured to drive the heating assembly 2 to move linearly and reciprocally between the first position and the second position. The circuit board 5 is powered by the battery 4. The circuit board 5 is electrically connected to the heating assembly 2 and the electric motor 31 with conductive wires, respectively.

In some embodiments, the electric motor 31 is a rotational electric motor. The driving assembly 3 may further include a screw 32 and a mounting seat 33. The screw 32 is coupled with an output shaft of the electric motor 31 so as to be driven to rotate by the electric motor 31. The mounting seat 33 is provided with a threaded hole 334, and the mounting seat 33 is in threaded connection with the screw 32 through the threaded hole 334, and is driven by the screw 32 to move along a direction which is in parallel with an axial direction of the screw 32 linearly and reciprocally. The heating assembly 2 is mounted onto the mounting seat 33, and is driven by the mounting seat 33 to move along the direction which is in parallel with the axial direction of the screw 32 linearly and reciprocally. The axis of the screw 32 is in parallel with that of the cigarette 6 and the receiving space 132. By this arrangement, the move direction of the heating assembly 2 is in parallel with the axial direction of the cigarette 6, thus when the heating assembly 2 is moved from the first position to the second position to be separated from the cigarette 6, the cigarette 6 will not be broken.

After the cigarette 6 within the low-temperature baked device is exhausted, the electric motor can be driven to rotate by the circuit board 5 such that the screw 32 is rotated accordingly to further drive the mounting seat 33 to move linearly along the screw 32. Then the mounting seat 33 will drive the heating assembly 2 to move from the first position to the second position such that the heating assembly 2 is quickly separated from the cigarette 6. Then the user can readily remove the cigarette 6 from the device without any residues remained within the pushing tube 13. Meanwhile, the heating assembly 2 is prevented from being contaminated by the residues which will inadvertently reduce the heating performance of the heating assembly 2. In addition, the bottom wall 133 and the partition 121 can also exert a friction action onto the heating element 21 so as to remove any residues thereon. Furthermore, since the heating assembly 2 displaces linearly along the axial direction of the cigarette 6, this will ensure the cigarette 6 from being broken apart. When a new cigarette needs to be heated again, the electric motor can be driven to rotate reversely, such that the heating assembly 2 will be driven by the mounting seat 33 to move from the second position to the first inserting port 131 and finally reaches to the first position. Then the new cigarette can be readily inserted into the device from the first inserting port 131 and seated onto the heating assembly 2.

The axises of the screw 32 and the rotational electric motor can be staggered with that of the heating assembly 2, so as to give a space for the movement of the heating assembly, and to benefit a compact design in the height direction. In other embodiments, the screw 32 and the rotational electric motor can be arranged right under the heating assembly 2.

The mounting seat 33 can be sleeved to a bottom portion or a portion adjacent to the bottom portion of the heating assembly 2. An external dimension of the second inserting port 1331 and an inner hole dimension of the partition 121 can be set to be smaller than an external dimension of the mounting seat 33, so that the mounting seat 33 can be resisted and limited.

In some embodiments, the lower case 12 may be further provided with a first guide portion 123, the mounting seat 33 may be provided with a second guide portion 331 which is slideably coupled with the first guide portion 123 via a convex/concave fit. The first guide portion 123 extends along the moving direction of the heating assembly 2. The first guide portion 123 and the second guide portion 331 are mutually coupled via a convex/concave fit to configure a guiding rail structure to increase the stability of the mounting seat 33 when in moving. In the current embodiment, an inner wall surface of the lower shell 12 extends inward (ie, a direction toward the mounting seat 33) to form a pair of ribs extending along the moving direction of the heating assembly 2. A sliding groove defined between the pair of ribs configures the first guide portion 123. An outer wall surface of the mounting seat 33 extends outward (ie, a direction toward the first guide portion 123) to form a slide which configures the second guide portion 331. In other embodiment, alternatively, the first guide portion 123 may be a sliding groove defined by recessing outward (ie, a direction away from the mounting seat 33) from an inner wall surface of the lower case 12, and the second guide portion 331 may be a slide formed by extending outward from an outer wall surface of the mounting seat 33; or alternatively, the first guide portion 123 may be a sliding portion formed by extending inward from an inner wall surface of the lower case 12, and the second guide portion 331 may be a sliding groove defined by recessing inward (ie, a direction away from the first guide portion 123) from an inner wall of the mounting seat 33 or extending outward from an inner wall of the mounting seat 33.

In some embodiments, the heating assembly 2 may further include a bracket 22, and the heating element 21 can be installed onto the mounting seat 33 via the bracket 22. When assembling, a bottom portion or a portion adjacent to the bottom portion of the heating element 21 can be fixed to the bracket 22 firstly, then the bracket 22 can be mounted to the mounting seat 33. In some embodiments, the bracket 22 may include a first half portion 221, and a second half portion 222 located on a side of the first half portion 221 distant to the cigarette 6. The dimensions of the second inserting port 1331 and the through hole 1211 of the partition 121 are smaller than an external dimension of the first half portion 221 in order to prevent the bracket 22 from passing through the through hole 1211 and the second inserting port 1331 when the heating assembly 2 moving upwardly. In addition, an external dimension of the second half portion 222 and a dimension of the mounting hole 333 of the mounting seat 33 are smaller than the external dimension of the first half portion 221, which will benefit installation and positioning of parts. When assembling, the heating element 21 is inserted into the bracket 22 from one side of the first half portion 221, and the bottom portion of the heating element 21 abuts against a bottom portion of the second half portion 222. Then the bracket 22 is inserted into the mounting hole 333 of the mounting seat 33. A step surface formed between the first half portion 221 and the second half portion 222 abuts against an end surface of a top portion of the mounting seat 33.

Further, a first contact 2221 may be provided on an outer wall of the bracket 22 for electrical interconnection with the heating element 21. A second contact 332 may be provided within an inner wall of the mounting hole 333 of the mounting seat 33 for electrical interconnection with the circuit board 5. When the bracket 22 is mounted onto the mounting seat 33, the first contact 2221 is in contact conduction with the second contact 332, such that the heating element 21 is electrically interconnected with the circuit board 5 and is therefore powered by the circuit board 5.

In some embodiments, the low-temperature baked device may further include a distance measuring device, such as an infrared distance measuring device or a magnetic distance measuring device, so as to avoid the mounting seat 33 or the bracket 22 hitting the partition 121 and the pushing tube 13 due to an excessive upward displacement of the mounting seat 33 or the bracket 22 is incurred. By this arrangement, the mounting seat 33 or the bracket 22 will stop moving automatically when moving upward to a predetermined stroke. The distance measuring device may include an emitter 71 and a receiver 72. The emitter 71 can be installed on a bottom portion of the pushing tube 13 or onto the partition 121, and the receiver 72 can be installed onto the mounting seat 33 or the bracket 22. Alternatively, the receiver 72 can be installed onto the bottom portion of the pushing tube 13 or the partition 121, and the emitter 71 can be installed onto the mounting seat 33 or the bracket 22.

Figure 6:
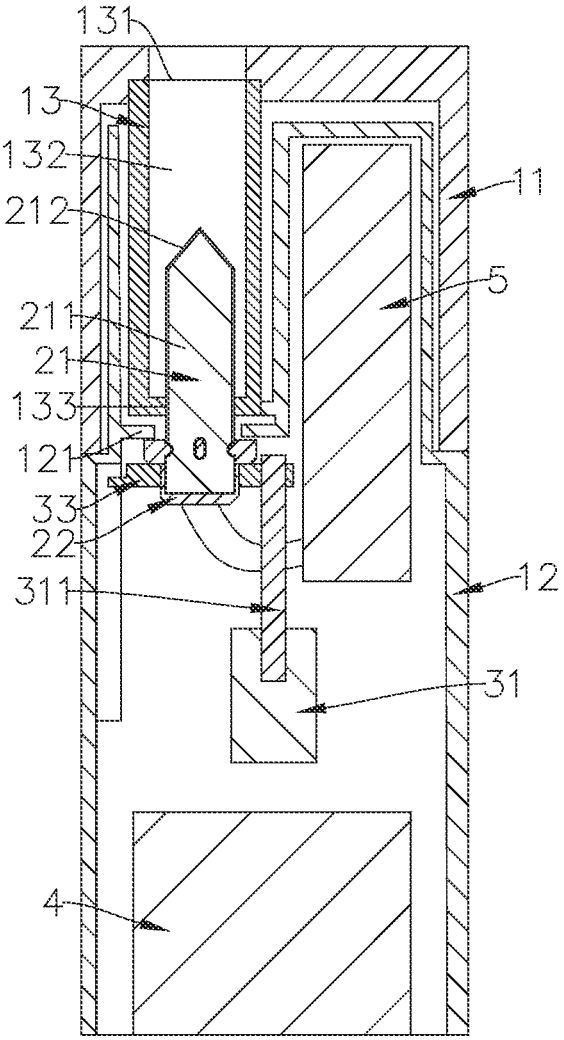
FIG. 6 is a longitudinal sectional view of a low-temperature baked device in which the heating assembly is located at a first position in a second embodiment.

FIG. 6 illustrates a low-temperature baked device according to a second embodiment of the present disclosure. A main difference between the first and second embodiments is that in the second embodiment, the electric motor 31 is a linear electric motor. An output shaft 311 of the linear electric motor is coupled with the mounting seat 33, and the heating assembly 2 can be driven by the mounting seat 33 to move linearly and reciprocally in an axial direction of the cigarette 6 between a first position and a second position. Alternatively, the output shaft 311 of the linear electric motor can be directly coupled to the heating element 21 such that the heating assembly 2 can be driven to move linearly in the axial direction of the cigarette 6 reciprocally between the first position and the second position. Alternatively, the output shaft 311 of the linear electric motor can be coupled to the heating element 21 through the bracket 22 such that the bracket 22 and the heating element 21 can be driven to move linearly in the axial direction of the cigarette 6 reciprocally between the first position and the second position. In some embodiments, the linear electric motor is a piezoelectric motor.

Similar to the first embodiment, an axis of the linear electric motor can be staggered with that of the heating assembly 2, to give a space for movement of the heating assembly 2, and to benefit a compact design of the device in the height direction. In other embodiments, the linear electric motor can be arranged right under the heating assembly 2.

It can be understood that each of the technical features described above can be combined in any desired way, without subjecting to any constraints.

The above embodiments illustrate only the preferred embodiments of the present disclosure, of which the description is made in a specific and detailed way, but should not be thus construed as being limiting to the scope of the claims of present disclosure. Those having ordinary skill of the art may freely make combinations of the above-described technical features and make contemplate certain variations and improvements, without departing from the idea of the present disclosure, and all these are considered within the coverage scope of the claims of the present disclosure.

What is claimed is:

1. A low-temperature baked device, characterized by comprising a main body, a heating assembly, and a driving assembly; wherein the main body defines a receiving space for receiving a cigarette; the heating assembly comprises an insertion portion for inserting into the cigarette, and the driving assembly is coupled to the heating assembly; and wherein the heating assembly is disposed in the main body, and is able to move linearly under a drive of the driving assembly along an axial direction of the cigarette between a first position at which the heating assembly is inserted into the cigarette, and a second position at which the heating assembly is at least partly separated from the cigarette; and wherein the insertion portion is extended completely into the receiving space when the heating assembly is located at the first position, and the heating assembly is at least partially displaced out of the receiving space when the heating assembly is located at the second position; and wherein the main body comprises an outer shell and a pushing tube disposed in the outer shell, an inner hole of the pushing tube defines the receiving space, one end in an axial direction of the pushing tube defines a first inserting port for insertion of the cigarette, and another end in an axial direction of the pushing tube is provided with a bottom wall, a second inserting port is defined in the bottom wall for insertion of the insertion portion, the outer shell is provided with a partition to support the pushing tube thereon, the partition is provided with a through hole corresponding to the second inserting port, shapes of the second inserting port and the through hole are matched with a shape of a cross section of the insertion portion, and the bottom wall and the partition exert a friction action onto the heating assembly so as to remove residues thereon when the heating assembly moves from the first position to the second position; and wherein the driving assembly further comprises a mounting seat for disposing the heating assembly, the mounting seat comprises a mounting hole, the heating assembly comprises a heating element and a bracket, the heating element is installed onto the mounting seat via the bracket; the bracket comprises a first half portion and a second half portion located on a side of the first half portion distant to the cigarette, the dimensions of the second inserting port and the through hole of the partition are smaller than an external dimension of the first half portion, an external dimension of the second half portion and a dimension of the mounting hole of the mounting seat are smaller than an external dimension of the first half portion; the bracket is provided with a first contact for electrically interconnecting with the heating element, the mounting seat is provided with a second contact, and the first contact is in contact conduction with the second contact when the bracket is installed onto the mounting seat.

2. The low-temperature baked device according to claim 1, wherein the driving assembly comprises an electric motor disposed in the outer shell, and the electric motor is coupled with the heating assembly so as to drive the heating assembly to move linearly between the first position and the second position.

3. The low-temperature baked device according to claim 2, wherein the electric motor is a linear electric motor having an output shaft coupled with the heating assembly so as to drive the heating assembly to move linearly and reciprocally between the first position and the second position along the axial direction of the cigarette.

4. The low-temperature baked device according to claim 2, wherein the mounting seat connects the electric motor with the heating assembly so as to drive the heating assembly to move linearly between the first position and the second position along the axial direction of the cigarette.

5. The low-temperature baked device according to claim 4, wherein the electric motor is a rotational electric motor, and the driving assembly further comprises a screw coupled with an output shaft of the rotational electric motor, and an axis of the screw is in parallel to an axis of the cigarette; and the mounting seat is sleeved onto the screw in a threaded connection, so as to drive the heating assembly to move linearly between the first position and the second position along the axial direction of the cigarette.

6. The low-temperature baked device according to claim 5, wherein axes of the screw and the rotational electric motor are staggered with that of the heating assembly.

7. The low-temperature baked device according to claim 4, wherein the mounting seat is sleeved on the heating assembly, and an external dimension of the mounting seat is larger than a dimension of the second inserting port.

8. The low-temperature baked device according to claim 4, wherein and an end portion of the heating element facing the first inserting port forms the insertion portion.

9. The low-temperature baked device according to claim 8, wherein the heating element is sheet-shaped, and an end portion of the heating element facing the first inserting port is isosceles triangular or isosceles trapezoid.

10. The low-temperature baked device according to claim 8, wherein the heating element is rod-shaped, and an end portion of the heating element facing the first inserting port is conical or a truncated conical.

11. The low-temperature baked device according to claim 4, wherein the outer shell is provided with a first guide portion extending along a moving direction of the heating assembly, and the mounting seat is provided with a second guide portion slidably coupled with the first guide portion via a convex/concave fit.

12. The low-temperature baked device according to claim 1, wherein the outer shell comprises a lower case and an upper case covered on an upper end of the lower case, and the pushing tube is disposed on a top portion of the lower case; and the lower case is provided with the partition to support the pushing tube.

13. The low-temperature baked device according to claim 1, wherein the outer shell comprises a lower case and an upper case covered on an upper end of the lower case, and the pushing tube is integrally formed with the upper case.

14. The low-temperature baked device according to claim 2, wherein the low-temperature baked device further comprises a battery disposed in the outer shell, and a circuit board powered by the battery, the circuit board is electrically connected to the heating assembly and the electric motor respectively.

* * * * *